US006663309B2

(12) United States Patent
Zamansky et al.

(10) Patent No.: US 6,663,309 B2
(45) Date of Patent: Dec. 16, 2003

(54) CLEANING UTENSIL

(75) Inventors: Noah A. Zamansky, New York, NY (US); John L. Callendrille, Plainview, NY (US)

(73) Assignee: WKI Holding Company, Inc., Reston, VA (US)

( * ) Notice: Subject to any disclaimer, the term of this patent is extended or adjusted under 35 U.S.C. 154(b) by 0 days.

(21) Appl. No.: 10/141,087

(22) Filed: May 8, 2002

(65) Prior Publication Data

US 2003/0210947 A1 Nov. 13, 2003

(51) Int. Cl.[7] ..... A47L 13/30; B43K 5/00

(52) U.S. Cl. ..... 401/264; 401/205; 401/206; 401/263

(58) Field of Search ..... 401/264, 263, 401/265, 266, 196, 207, 6, 187, 188 R, 205, 206; 16/421, 430, 436; 15/244.4; D4/137, 119, 124

(56) References Cited

U.S. PATENT DOCUMENTS

| | | | | |
|---|---|---|---|---|
| 2,303,660 | A | | 12/1942 | Schickel |
| 2,334,690 | A | | 11/1943 | Yden |
| 2,408,860 | A | * | 10/1946 | Lindblad ..... 15/244.1 |
| 2,820,234 | A | * | 1/1958 | Rigney ..... 401/186 |
| 2,893,029 | A | | 7/1959 | Vosbikian et al. |
| 3,189,069 | A | * | 6/1965 | Stowell ..... 81/177.1 |
| 3,409,926 | A | | 11/1968 | Martin |
| 4,747,720 | A | * | 5/1988 | Bellehumeur et al. ..... 401/205 |
| 4,826,340 | A | * | 5/1989 | Rothweiler et al. ..... 401/279 |
| 4,866,806 | A | | 9/1989 | Bedford |
| RE34,194 | E | * | 3/1993 | Stowell et al. ..... 16/111 R |
| D336,160 | S | | 6/1993 | Shumway et al. |
| 5,312,197 | A | | 5/1994 | Abramson |
| 5,336,330 | A | | 8/1994 | Shumway et al. |
| D367,137 | S | | 2/1996 | Pollak et al. |
| 5,491,863 | A | | 2/1996 | Dunn |
| 5,555,591 | A | | 9/1996 | Chang |
| 5,560,070 | A | | 10/1996 | Reaume |
| D375,595 | S | | 11/1996 | Shumway et al. |
| D384,507 | S | | 10/1997 | Mudie |
| D387,704 | S | | 12/1997 | Berti |
| 5,715,559 | A | | 2/1998 | Mitri |
| D391,705 | S | | 3/1998 | Good |
| D392,433 | S | | 3/1998 | Norris |
| D393,115 | S | | 3/1998 | Bell et al. |
| D408,106 | S | | 4/1999 | Cousins et al. |
| 6,146,040 | A | | 11/2000 | Dunn et al. |
| D435,155 | S | | 12/2000 | Katsukawa |
| D436,703 | S | | 1/2001 | Finamore |
| 6,202,247 | B1 | | 3/2001 | Lorenz, Jr. |
| 6,210,064 | B1 | | 4/2001 | White et al. |
| D443,742 | S | | 6/2001 | Williams-Wynn |
| 6,240,592 | B1 | | 6/2001 | Li |

OTHER PUBLICATIONS

Instruction sheet and photograph of Sassy bottle brush, prior to May 2001.
Photograph of OXO bottle brush, prior to May 2001.
Photograph of Melody bottle brush, prior to May 2001.

* cited by examiner

*Primary Examiner*—David J. Walczak
(74) *Attorney, Agent, or Firm*—Seyfarth Shaw LLP

(57) ABSTRACT

A replaceable cleaning head for a cleaning utensil includes a rigid core having a handle end and a working end, coupling structure on the handle end of the core adapted to be coupled to an associated handle, and a flexible, resilient, porous, absorbent cleaning medium mounted on the core and covering the core except for the coupling structure. The head may be hollow, and threadedly connectable to an end of a hollow handle for defining a fluid reservoir, the head having an orifice for providing communication between the reservoir and the cleaning medium. The cleaning medium has axially alternating circumferential recesses and projections facilitating axial compression and expansion of the medium to draw fluid from the reservoir.

7 Claims, 4 Drawing Sheets

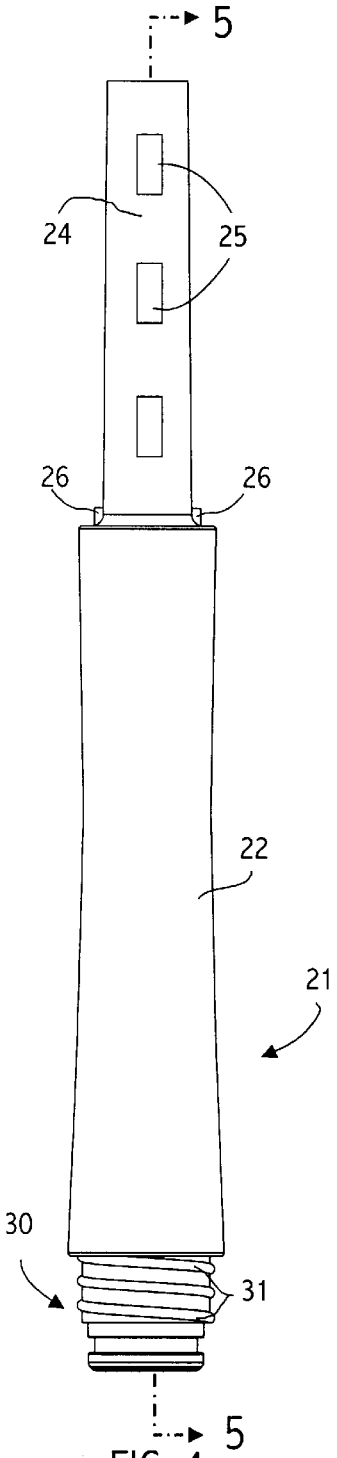
FIG. 4
FIG. 9
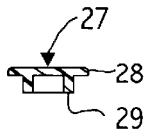
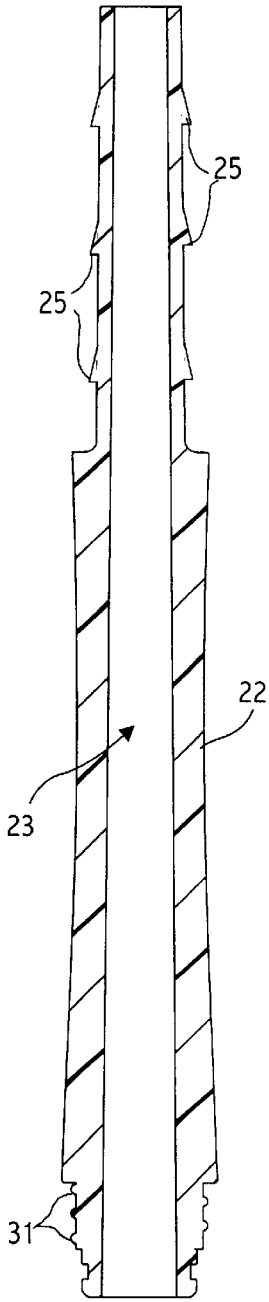
FIG. 5
FIG. 6
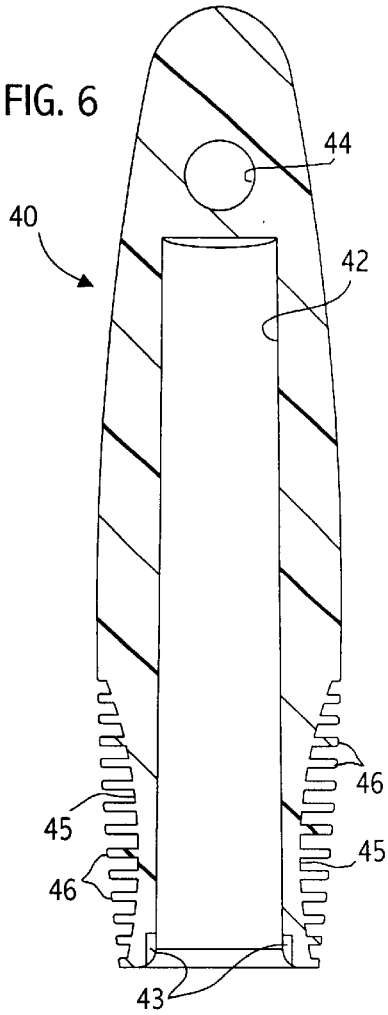
FIG. 7
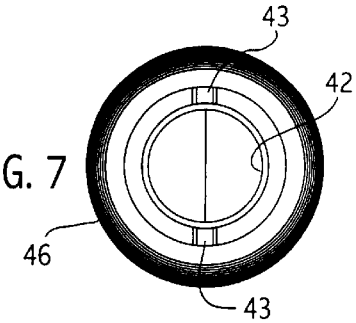
FIG. 8
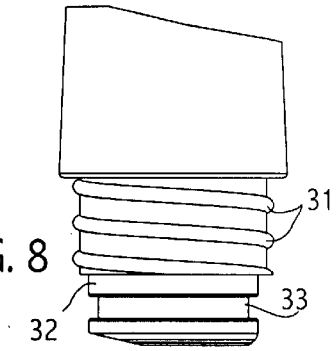

CLEANING UTENSIL

BACKGROUND

This application relates to cleaning utensils and, in particular, to utensils of the type including a cleaning medium communicable with a reservoir of cleaning fluid.

Various types of cleaning implements in the nature of brushes and the like, have long been known. Such implements typically include a handle portion and a head or working portion including a cleaning medium, such as brush bristles, a sponge, or the like. It is also known to provide such cleaning devices with a reservoir for a fluid, such as a cleaning fluid, as well as a dispensing mechanism for dispensing cleaning fluid from the reservoir into the cleaning medium. This dispensing mechanism typically includes a valve mechanism. Such valves increase the expense of manufacturer and assembly of the device, a situation which may be exacerbated by the fact that the entire device must be replaced when the cleaning medium wears out.

SUMMARY

This application discloses an improved cleaning utensil and method of using same which avoids the disadvantages of prior utensils and methods while affording additional structural and operating advantages.

An important aspect is the provision of a cleaning utensil with a replaceable cleaning head.

In connection with the foregoing aspect, another aspect is the provision of a replaceable cleaning head for such a utensil.

A still further aspect is the provision of a utensil of the type set forth, with a fluid reservoir and means for dispensing the fluid from the reservoir to a cleaning medium.

Yet another aspect is the provision of a method of using a cleaning utensil of the type set forth, involving alternate compression and expansion of a compressible cleaning medium to facilitate drawing of cleaning fluid from the reservoir.

Certain ones of these and other aspect may be attained by providing a replaceable cleaning head for a cleaning utensil comprising a rigid core having a handle end and a working end, coupling structure on the handle end of the core adapted to be coupled to an associated handle, and a flexible, resilient, porous, absorbent cleaning medium mounted on the core and covering the core except for the coupling structure.

BRIEF DESCRIPTION OF THE DRAWINGS

For the purpose of facilitating an understanding of the subject matter sought to be protected, there is illustrated in the accompanying drawings an embodiment thereof, from an inspection of which, when considered in connection with the following description, the subject matter sought to be protected, its construction and operation, and many of its advantages should be readily understood and appreciated.

FIG. 4 is a front elevational view of the handle of the cleaning utensil of FIG. 2;

FIG. 5 is a sectional view taken generally along the Line 5—5 in FIG. 4;

FIG. 6 is an enlarged sectional view of the grip of the utensil of FIG. 2;

FIG. 7 is an end elevational view of the grip FIG. 6, as viewed from the lower end thereof;

FIG. 8 is an enlarged, fragmentary view of the lower end of the handle of FIG. 4;

FIG. 9 is a sectional view of the cap of the handle of FIG. 5;

DETAILED DESCRIPTION

Figure 1:
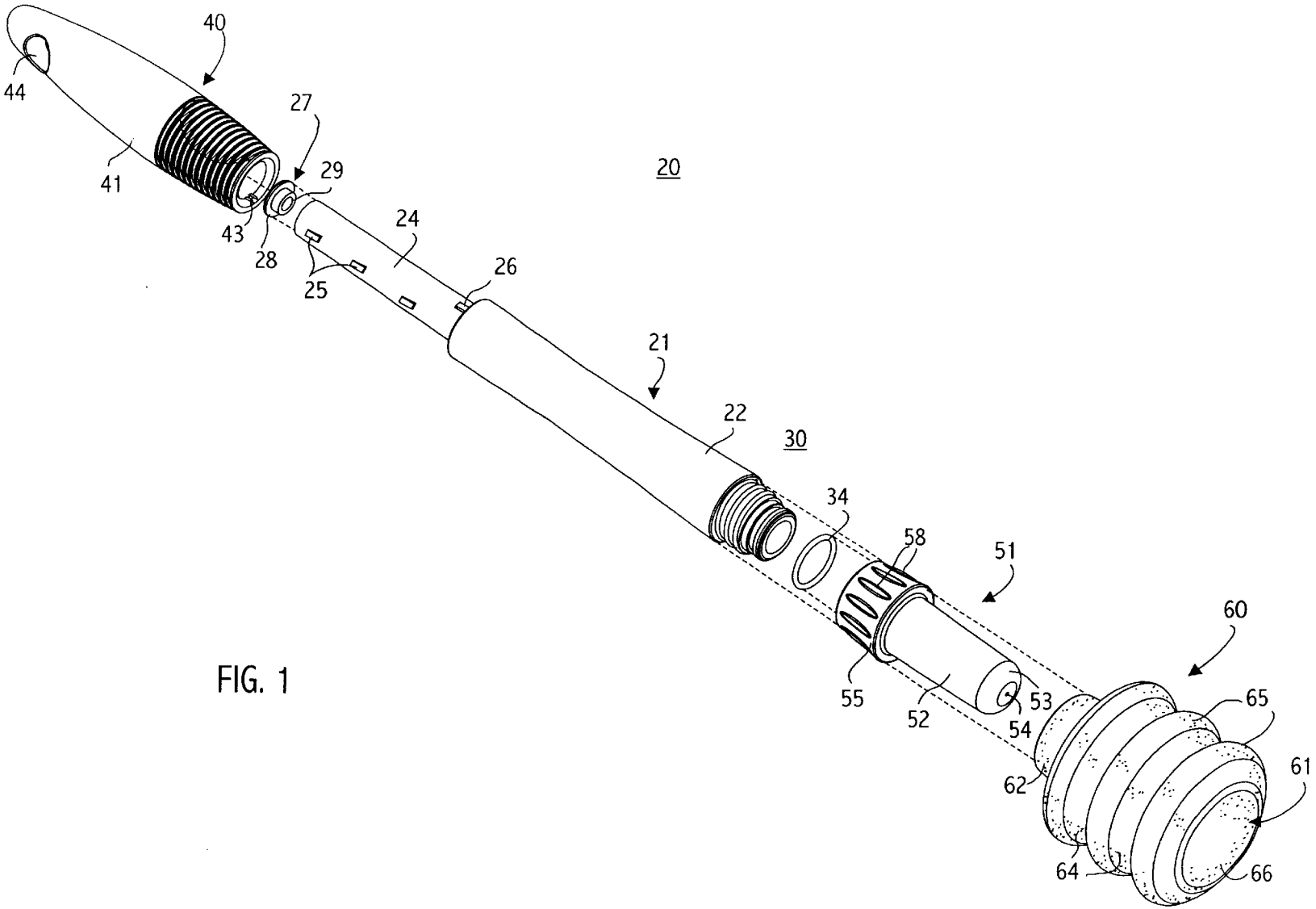
FIG. 1 is a perspective, exploded view of a cleaning utensil.
Figure 2:
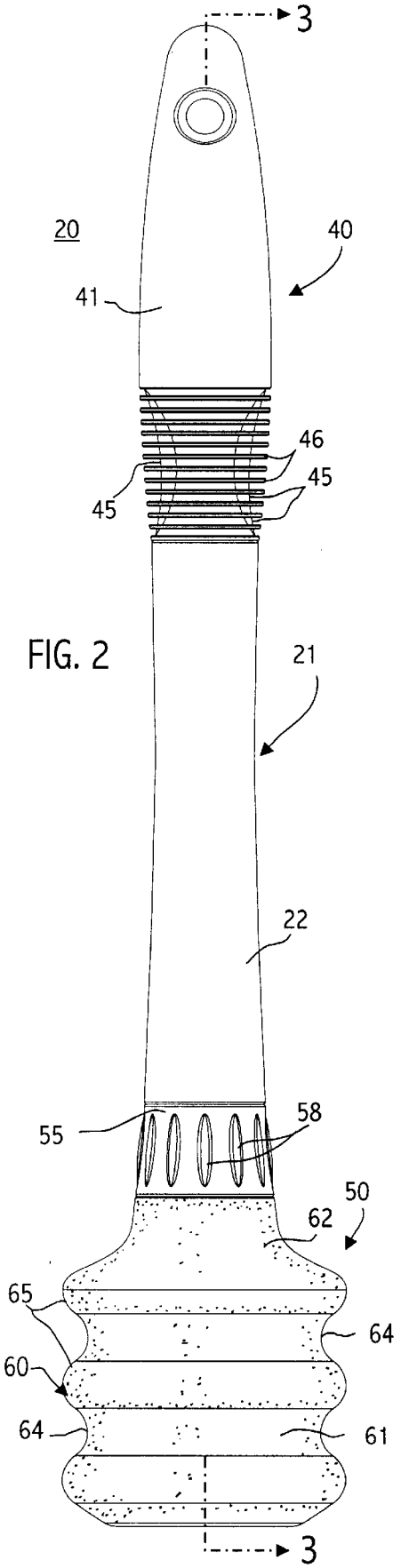
FIG. 2 is an enlarged, front elevational view of the assembled cleaning utensil of FIG. 1.

Referring now to FIGS. 1–5, there is illustrated a cleaning utensil, generally designated by the numeral 20, having a replaceable cleaning head 50. The utensil 20 includes an elongated handle 21 having a generally tubular body 22 and defining a cylindrical passage extending longitudinally therethrough and forming a chamber 23. The body 22 has a reduced-diameter grip end 24 provided with two diametrically opposed rows of longitudinally spaced prongs 25, each of which is generally triangular and transverse cross-section (see FIG. 5), sloping radially outwardly and downwardly toward the opposite end of the body 22. Also, projecting radially outwardly from the grip end 24 at diametrically opposed locations at the proximal end of the grip end 24 are projections or lugs 26. The handle is provided with a cap 27 having a circular end plate 28 integral with a reduced-diameter, hollow, cylindrical hub 29 dimensioned to fit within the distal end of the grip end 24 to close that end of the chamber 23 (see FIGS. 3 and 9).

Figure 3:
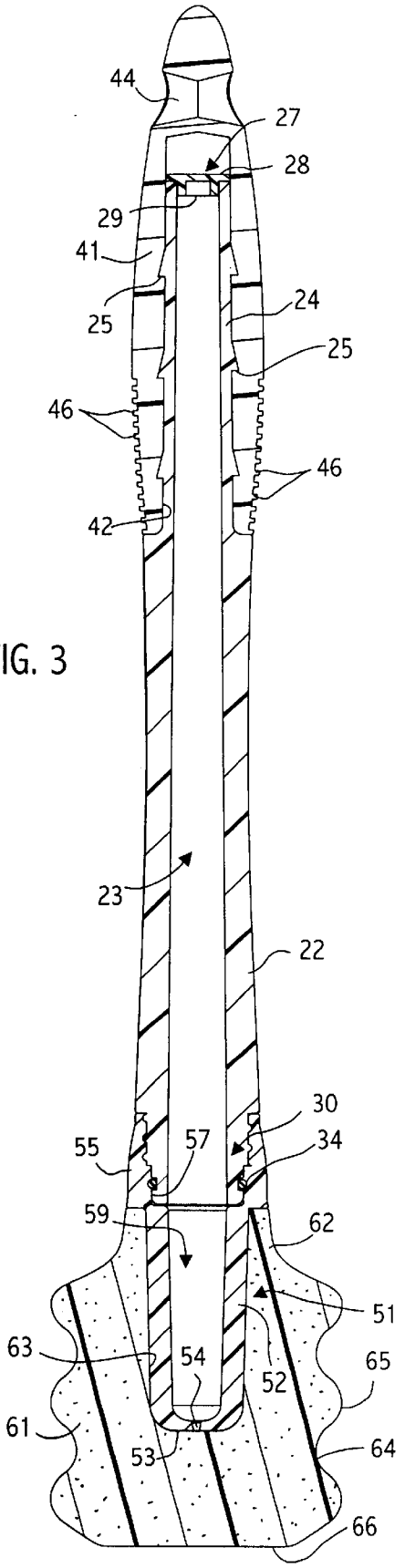
FIG. 3 is a sectional view taken generally along the line 3—3 in FIG. 2.

The handle body 22 also has, at a head end opposite the grip end 24, a reduced diameter neck 30 which is provided with coupling structure including an external helical thread 31. Referring also to FIG. 8, the distal end of the neck 30 has a further reduced-diameter portion 32 having a circumferential groove 33 formed therein for receiving an 0-ring 34 (FIGS. 1 and 3).

The cleaning utensil 20 also includes a grip 40 having an elongated, generally oval-shaped shaped body 41 provided at one end with an axial socket bore 42. Formed in the bore 42 adjacent to the open end thereof at diametrically opposed locations are two recesses 43. Formed through the body 41 at the opposite end of the grip 40 is a hole 44 to facilitate hanging the utensil. Formed in the outer surface of the grip body 41 at the forward end thereof are two diametrically opposed concave recesses 45. The grip 40 has a plurality of axially-spaced peripheral flanges or ribs 46 which extend around the entire periphery of the grip body 41 in the region of the recesses 45, forming in the recesses 45 flexible and resilient fins. The grip 40 and, in particular, the finned recesses thereof, are substantially of the type disclosed in U.S. Pat. No. RE 37,190, the disclosure of which is incorporated herein by reference and may be referred to for structural and functional details.

In assembly, the grip end 24 of the handle body 22 is press-fitted in the socket bore 42 of the grip 40, until the open end of the grip body 41 seats against the shoulder defined at the forward end of the grip end 24. The parts are so dimensioned that during this mounting operation, the prongs 25 will dig into the material of the grip body 41 to inhibit axial removal of the grip 40. The grip 40 is mounted so that the projections 26 will be respectively received in the recesses 43 to inhibit relative rotational movement of the handle body 22 and grip body 41. The handle body 22 may be formed of a suitable rigid plastic material, while the grip body 41 may be formed of a flexible and resilient plastic material, such as that sold under the trade name SANTOPRENE.

Figure 10:
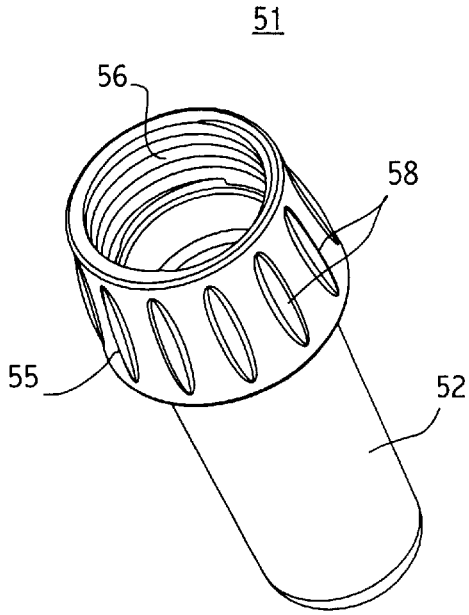
FIG. 10 is an enlarged, perspective view of the head core of the utensil of FIG. 2.
Figure 11:
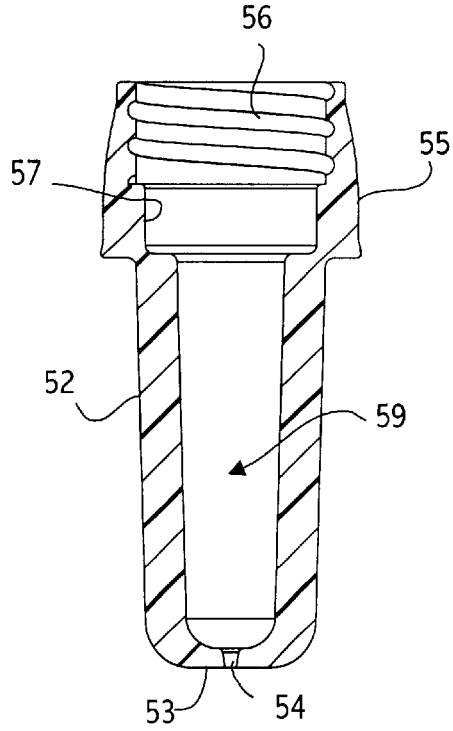
FIG. 11 is a sectional view of the core FIG. 10.

Referring also to FIGS. 10 and 11, the cleaning head 50 includes a rigid core 51 and a cleaning medium 60 formed of a suitable flexible, resilient, porous and absorbent material. The core 51 is generally cylindrical in shape, having a generally tubular sidewall 52 closed at a working end thereof by an end wall 53 having an orifice 54 formed therethrough centrally thereof Integral with the open or handle end of the sidewall 52 and projecting axially therefrom is an enlarged-diameter, generally cylindrical neck 55 provided with coupling structure including an internal helical thread 56 (see FIGS. 10 and 11) and having a reduced-diameter, substantially cylindrical sealing surface 57 inwardly of the thread 56. Forming the outer surface of the neck 55 are a plurality of axially elongated and circumferentially spaced, generally oval-shaped recessed 58 to provide an improved gripping surface. The hollow core 51 defines therein a cavity 59.

The cleaning medium 60 may be formed of a spongy material, such as a suitable synthetic foam material, and has a generally cylindrical body 61 provided with a reduced-diameter neck 62 at one end thereof. Formed in the neck 62 and extending axially into the body 61 is an elongated cylindrical socket 63. Formed in the outer surface of the body 61 are a plurality of axially spaced, circumferentially extending recesses 64, which cooperate to define radially outwardly projecting circumferential projections 65. The body 61 has a flat, circular, distal end surface 66. In assembly, the head core 51 is fitted into the socket 63 of the cleaning medium 60, until the neck 62 of the cleaning medium 60 seats against the neck 55 of a head core 51. The parts maybe secured together, as by a suitable adhesive.

In use, the chamber 23 in the handle 21 may be filled with a suitable cleaning fluid, such as a liquid soap, through the neck 30. Then, the cleaning head 50 is mounted in place on the handle 21 by threading the core neck 55 onto the handle neck 30. When thus assembled, the 0-ring 34 will be disposed in fluid-tight sealing engagement with the sealing surface 57 of the head core 51, as can best be seen in FIG. 3. When thus assembled, the head cavity 59 communicates with the handle chamber 23 and cooperates therewith to define a reservoir for the fluid, the O-ring seal preventing leakage around the threadedly-engaged necks. This fluid may pass into the cleaning medium 60 through the orifice 54.

In order to facilitate the discharge of cleaning fluid into the cleaning medium 60, the circumferential recesses and projections 64 and 65 on the cleaning medium 60 facilitate axial compression and expansion thereof, as by pressing the flat end surface 66 of the cleaning 60 medium against an associated surface. This creates a suction effect to facilitate drawing the fluid from the reservoir through the orifice 54 and into the cleaning medium 60. Also, the circumferential projections 65 are useful for insertion into crevices or recesses in objects being cleaned to facilitate the cleaning operation.

It will be appreciated that, when the cleaning medium 60 wears out, the cleaning head 50 is readily replaceable by simply unscrewing from the handle 21 and screwing on a replacement head.

From the foregoing, it can be seen that there has been provided an improved cleaning utensil, a replaceable head therefore and a method of operation thereof, which are characterized by simple and economical construction and a unique ergonomic design.

The matter set forth in the foregoing description and accompanying drawings is offered by way of illustration only and not as a limitation. While a particular embodiment has been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A cleaning utensil comprising:

an elongated hollow handle having a longitudinal axis and grip end and a head end, the handle defining a chamber therein, and first coupling structure on the head end; and a replaceable head including a rigid hollow core having a handle end and a working end, the core defining a cavity therein, second coupling structure on the handle end of the core adapted for engagement with the first coupling structure to mount the core on the handle in a use condition with the cavity communicating with the chamber to define a fluid reservoir, a flexible, resilient, porous, absorbent cleaning medium formed of a synthetic foam material mounted on the core and covering the core except for the second coupling structure, the cleaning medium having a generally cylindrical outer surface including a plurality of axially spaced circumferentially extending recesses formed therein, and an orifice in the working end of the core providing communication between the reservoir and the cleaning medium.

2. The cleaning utensil of claim 1, and further comprising a grip formed of a flexible and resilient material and mounted on the grip end of the handle.

3. The cleaning utensil of claim 2, wherein the grip end of the handle has a plurality of laterally outwardly-projecting prongs thereon engageable with the grip to inhibit removal thereof.

4. The cleaning utensil of claim 2, and further comprising a projection on the grip end of the handle and a recess in the grip receiving the projection to inhibit rotational movement of the grip relative to the handle.

5. The cleaning utensil of claim 1, wherein the handle is an elongated tubular member, and further comprising a cap closing an end of the handle to define the chamber.

6. The cleaning utensil of claim 1, wherein the first coupling structure includes an externally threaded neck and the second coupling structure includes an internally threaded neck threadedly engageable with the first coupling structure.

7. The cleaning utensil of claim 6, and further comprising a circumferential groove on the externally threaded neck, a sealing surface on the internally threaded neck and an O-ring seal seated in the groove for sealing engagement with the sealing surface when the core is mounted in its use condition.

* * * * *

UNITED STATES PATENT AND TRADEMARK OFFICE

CERTIFICATE OF CORRECTION

PATENT NO. : 6,663,309 B2 
DATED : December 16, 2003
INVENTOR(S) : John L. Callendrille and Noah Zamansky It is certified that error appears in the above-identified patent and that said Letters Patent is hereby corrected as shown below:

Title page,
Item [75], Inventors, first inventor's name should read -- John L. Calendrille --

Signed and Sealed this

Twenty-fourth Day of August, 2004

JON W. DUDAS
*Director of the United States Patent and Trademark Office*